US006485347B1

(12) United States Patent
Grubba et al.

(10) Patent No.: US 6,485,347 B1
(45) Date of Patent: Nov. 26, 2002

(54) PUFFING FAN DRIVEN SMOKE UNIT FOR A MODEL TRAIN

(75) Inventors: Robert A. Grubba, Rochester Hills, MI (US); James G. Morrison, Royal Oak, MI (US)

(73) Assignee: Lionel, L.L.C., Chesterfield, MI (US)

( * ) Notice: Subject to any disclaimer, the term of this patent is extended or adjusted under 35 U.S.C. 154(b) by 0 days.

(21) Appl. No.: 09/572,645

(22) Filed: May 17, 2000

(51) Int. Cl.[7] ..... A63H 19/14
(52) U.S. Cl. ..... 446/25; 446/24; 446/467
(58) Field of Search ..... 104/DIG. 1; 105/1.5; 246/473 A; 446/25, 24, 467

(56) References Cited

U.S. PATENT DOCUMENTS

| | | | | | |
|---|---|---|---|---|---|
| 3,665,681 | A | * | 5/1972 | Vitenko | 55/260 |
| 3,891,826 | A | | 6/1975 | Seuthe et al. | |
| 4,198,992 | A | | 4/1980 | Smith | |
| 4,332,101 | A | | 6/1982 | Tomita | |
| 4,374,038 | A | | 2/1983 | Tamara | |
| 4,741,717 | A | | 5/1988 | Wolf | |
| 4,871,115 | A | | 10/1989 | Hessey | |
| 5,069,230 | A | * | 12/1991 | Green | 446/24 |
| 5,205,771 | A | | 4/1993 | Sims | |
| 5,312,281 | A | * | 5/1994 | Takahashi et al. | 446/25 |
| 5,334,071 | A | * | 8/1994 | Mills | 446/186 |
| 5,512,001 | A | * | 4/1996 | Kent et al. | 446/25 |
| 5,610,359 | A | | 3/1997 | Spector et al. | |
| 5,870,524 | A | * | 2/1999 | Swiatosz | 392/394 |
| 5,896,017 | A | * | 4/1999 | Severson et al. | 312/280 |
| 5,944,502 | A | * | 8/1999 | Denchfield | 431/1 |
| 6,280,278 | B1 | * | 8/2001 | Wells | 446/25 |

* cited by examiner

*Primary Examiner*—Jacob K. Ackun
*Assistant Examiner*—Faye Francis
(74) *Attorney, Agent, or Firm*—Young & Basile, P.C.

(57) ABSTRACT

The present invention provides a smoke generator for a model train. The invention allows a toy locomotive to produce smoke as an actual train would, in a puffing pattern. The present achieves its purpose by manipulating the flow of air through a smoke generating housing with a fan and a blocking device.

18 Claims, 2 Drawing Sheets

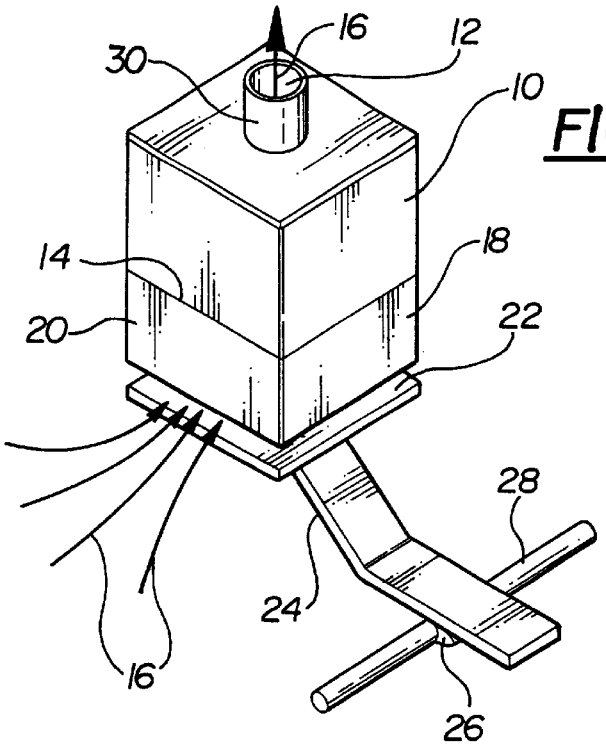
FIG-1
FIG-2
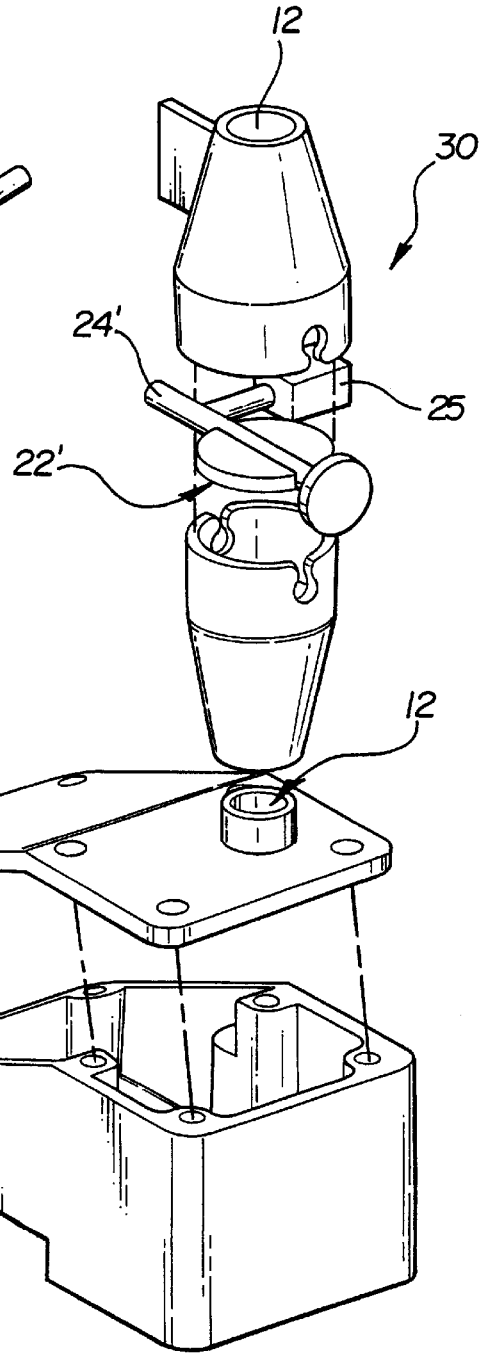
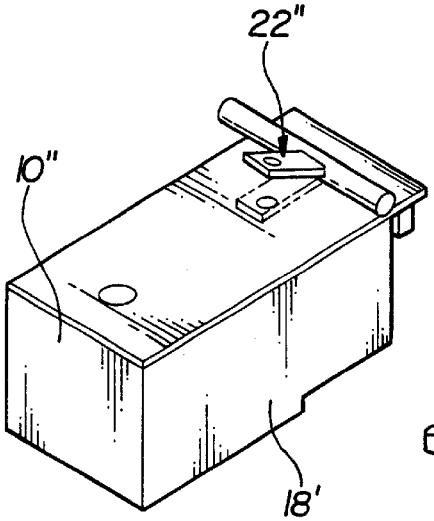
FIG-3

PUFFING FAN DRIVEN SMOKE UNIT FOR A MODEL TRAIN

FIELD OF THE INVENTION

The present invention relates to a smoke unit for a model toy train. The smoke unit described herein produces smoke in a puffing pattern that is characteristic of actual trains.

BACKGROUND OF THE INVENTION

Thousands of individuals enjoy collecting and operating model toy trains. From the avid collector to the casual hobbyist, all are drawn to the trains, train cars and accessories that include a high level of detail. Ideally, the components of model railroads duplicate exactly their real life counterparts.

Steam engines replicas are among the favorites of collectors. Model toy train manufacturers have successfully developed means for producing smoke in a puffing pattern, reminiscent of actual steam engines. Creating a puffing smoke pattern was accomplished through the use of a piston. The piston operated to force smoke out of a smoke unit and create the puffing action. The piston was driven through a linkage connected to one of the toy train wheels.

The problem with the piston assembly was its bulky size. This shortcoming became especially acute during the development of replicas of larger steam engines. One of the largest steam engines, the Union Pacific Big Boy, was outfitted with two sets of wheels which acted independently of one another. This is known as an articulated train. The replica, then, was also designed with two independent, articulated, sets of wheels. Incorporating two sets of wheels, in turn, meant that space for the puffing smoke piston assembly disappeared. However, the demand for realism in model locomotives required that the traditional puffing smoke pattern of the steam engine be duplicated.

Rather than doing without smoke at all the prior art attached a fan unit to the smoke housing to blow smoke out of the model toy train. The fan however was unable to produce a puffing action and therefore lacked the realism so many model toy train enthusiasts look for. The present invention provides an inventive solution to the problem of the prior art.

SUMMARY OF THE INVENTION

The present invention relates to a puffing smoke unit for a model toy train. The unit includes a smoke generator including an exhaust hole and a fan operative to create a flow of smoke from the smoke generator out the, exhaust hole. A blocker intermittently restricts the flow of smoke through the exhaust hole to create a puffing action.

The present invention also relates to a method of creating a puffing action in a model toy train which includes providing a fan and a smoke generator. A stream of smoke is generated from the smoke generator which is intermittently obstructed to create a puffing action.

It is to be understood that the flow of smoke may be restricted in a variety of fashions including both blocking plates and valves. The blocking mechanism can operate at a constant rate or at a rate proportional to the speed at which the model toy train is traveling.

BRIEF DESCRIPTION OF THE DRAWINGS

FIG. 1 is an isometric view of an embodiment of the present invention having a fan in a housing.

FIG. 2 is an isometric view of an embodiment of the present invention having a conduit.

FIG. 3 is an isometric view of an embodiment of the present invention having a fan in the smoke generator.

DESCRIPTION OF THE PREFERRED EMBODIMENT

Figure 4:
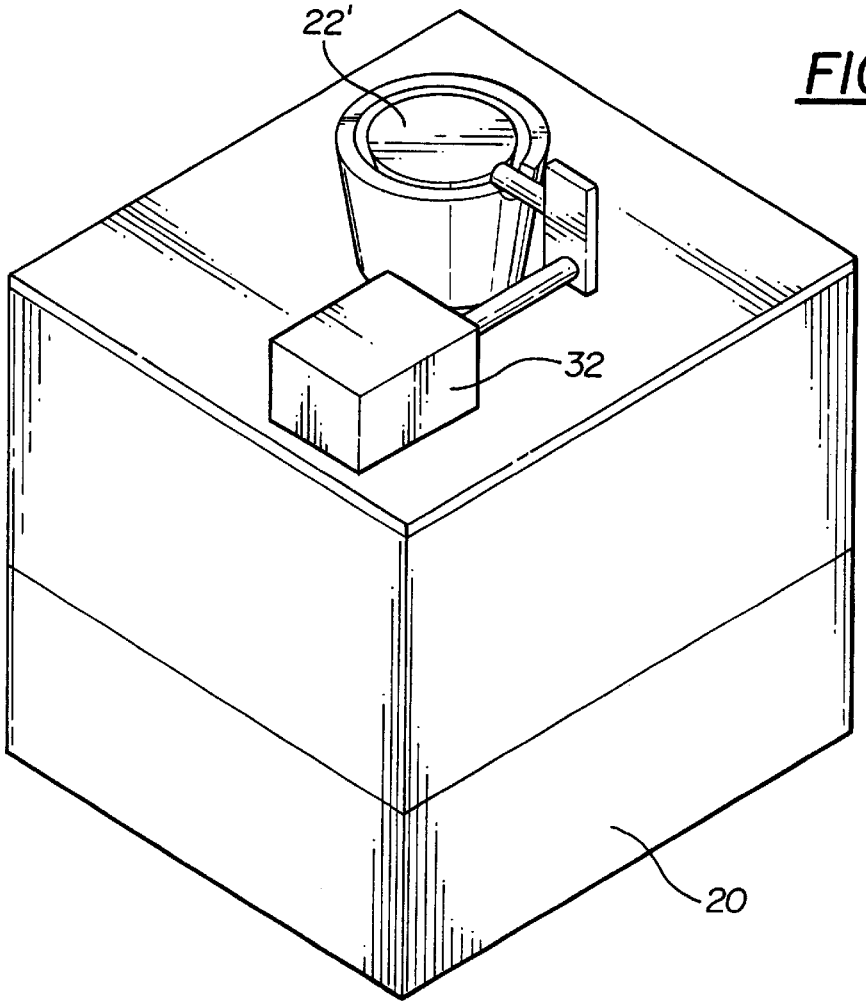
FIG. 4 is an isometric view of a smoke puffer unit including a solenoid.
Figure 5:
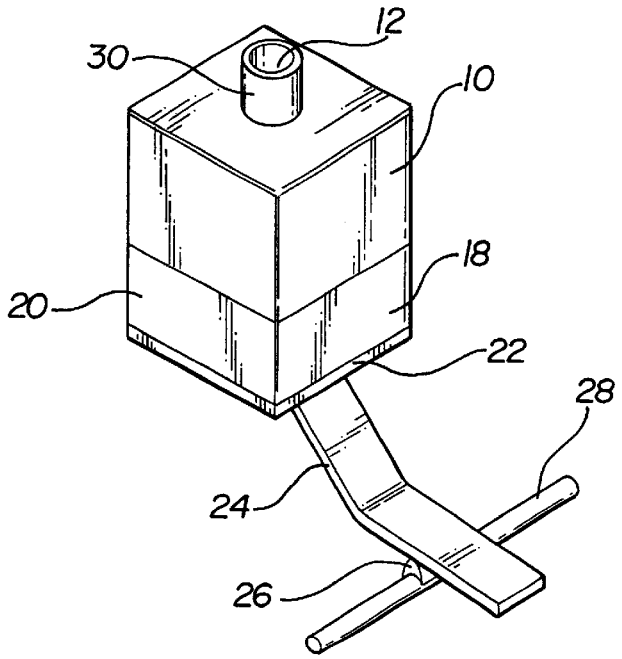
FIG. 5 is an isometric view of a first preferred embodiment of the present invention with the blocker in a closed position.

With reference to the FIGS. 1–4 wherein like elements are numbered alike there is shown a fan driven puffing smoke unit. The present invention creates a puffing action with a fan driven smoke unit by periodically obstructing the air flow created by the fan. Preferably the air flow is obstructed with a blocker plate. It is to be recognized that the air flow could be periodically obstructed with something equivalent to a blocker plate, for example a blocker valve.

With reference to FIG. 1, there is shown a puffing smoke assembly including a smoke housing 10. Smoke housings are well known in the art. Tamura, shown as container 2 in U.S. Pat. No. 4,374,038, and Seuthe, et al., shown as container 4 in U.S. Pat. No. 3,891,826, provide two examples of smoke housings which are both incorporated herein by reference. The smoke housing 10 may be made out of any material, however the material must be able to withstand the process by which smoke is created. Tamura teaches a smoke housing whereby smoke is created by heating a mixture of oil and water to boil. The present invention may be used with any of the methods of smoke generation currently known or subsequently developed.

Smoke housing 10 is breached by two holes, an exhaust hole 12 and an intake hole 14. Exhaust hole 12 and intake hole 14 facilitate an airstream 16 through the smoke housing 10. Preferably a fan 18, shown schematically, operates to create airstream 16 and draw air through smoke housing 10 to force smoke out exhaust hole 12. As air flows through smoke housing 10, the smoke generated within smoke housing 10 is emitted. The smoke joins ambient air. Preferably exhaust hole 12 is located on the top surface of the smoke housing 10, near or adjacent to a smoke stack of a model toy train (not shown).

Fan 18 may be powered by a direct current or alternating current and may be located within smoke housing 10 or adjacent thereto. Alternatively, fan 18 may be encased in a fan housing 20. Fan housing 20 may be positioned in either of two positions relative to smoke housing 10. Fan housing 20 may be positioned upstream or downstream from smoke housing 10. The stream refers to the direction of the airstream 16. Fan housing 20 may be joined to smoke housing 10 so that the housings 10 and 20 may be packaged together.

Fan 18 assists in the emission of smoke from the smoke housing 10. For example, if fan 18 is located upstream from the smoke housing 10 with respect to airstream 16, then fan 18 will act to force air into smoke housing 10 through hole 14 which will force smoke out of smoke housing 10 through hole 12. Alternatively, if fan 18 is positioned downstream from the smoke housing 10, then the rotation of the fan will draw smoke and air out of the exhaust hole 12 located on the smoke housing 10.

As shown in FIG. 1 a blocker plate 22 functions to manipulate the airstream 16 by restricting the flow path. Total restriction is not required by the present invention. The blocker may be a plate or valve. In one embodiment the blocker 22 is illustrated as a plate. Blocker 22 interrupts airstream 16 and allows smoke to accumulate in the housing 10. When airstream 16 is no longer obstructed the accumulated smoke will be forced out creating a "puffing" affect.

Blocker 22 intermittently restricts airstream 16. In the preferred embodiment the frequency that blocker 22 obstruct airstream 16 is directly proportional to the speed at which the model toy train is traveling. The faster the train is moving the faster blocker 22 will actuate. Although it is understood that the present invention is not limited to any particular frequency and the blocker may operate at a constant rate or an arbitrary rate.

Blocker 22 may be positioned either upstream or downstream of the smoke housing 10. In the first embodiment as shown in FIG. 1, blocker 22 is engaged and disengaged through the use of a lever arm 24. Lever arm 24 is connected to a cam 26 which is positioned on any axle 28 of the model train. As the axle 28 rotates, cam 26 forces lever arm 24 up and down thereby actuating blocker 22 to obstruct the intake of fan housing 20. By actuating blocker 22 with a cam driven by an axle 28 from the model toy train, the frequency at which blocker 22 operates is directly proportional to the speed at which the model toy train is traveling. However, present invention is not limited to any particular mechanism and it is understood that other mechanisms could be used, for example a biased weight as shown in FIGS. 2 and 3 or a solenoid as shown in FIG. 4.

The present invention creates the puffing effect in the following way. Blocker 22 engages to restrict the airstream 16. While blocker 22 is engaged, the fan 18 continues to operate. If the blocker is engaged upstream of fan 18 and the smoke housing 10, the operation of the fan 18 will create a partial vacuum. When blocker 22 disengages, the presence of the partial vacuum will cause a short, relatively stronger burst of airflow. This increased flow creates a "puff." If the blocker is engaged downstream of fan 18 and smoke housing 10, the operation of fan 18 will cause the air pressure within fan housing 20 and smoke housing 10 to rise. When blocker 22 disengages, the quantity of air under higher pressure will rapidly expand. This expansion also creates a "puff."

FIG. 2 illustrates a second preferred embodiment of the present invention which includes a conduit 30. Conduit 30 may be any length, shape or cross-section. As shown in FIG. 2, conduit 30 may be utilized to house a blocker 22'. As shown in conduit 30 extends from the exhaust hole 12. Although it is understood that conduit 30 allows fan 18 or smoke housing 10 to be placed anywhere within the train body. Conduit 30 thus provides valuable flexibility in the placement of the smoke housing 10 and fan housing 20 within the train body. As illustrated, conduit 30 extends exhaust hole 12 to the exterior smoke stack of a model toy train (not shown). As shown in FIG. 2, blocker 22' is driven from a lever arm 24'. As shown in FIG. 2, Lever arm 24' includes an offset weight 25. Offset weight 25 biases blocker to close exhaust hole 12. Air pressure builds to overcome the biasing effect of offset weight 25 and allow a puff of smoke to escape. The preferred embodiment of FIG. 2 creates a constant puffing pattern regardless of the speed of the toy train, so long as the fan speed is constant.

FIG. 3 illustrates a third preferred embodiment of the present invention. FIG. 3 illustrates a smoke housing 10" which has an air intake, and air exhaust on the same side of the unit. Smoke housing 10" includes an integral fan (not shown) which draws air into the housing. As illustrated, blocker 22" is a flapper valve is biased closed by its own weight. The embodiment of FIG. 3 operates in substantially the same manner as that of FIG. 2.

FIG. 4 illustrates a fourth preferred embodiment of the present invention in which the blocking valve is actuated by a solenoid 32. Solenoid 32 may be controlled in any fashion as recognized by those of skill in the art. Thus solenoid 32 may operate at a constant rate, or may increase or decrease how quickly it operates dependent on how fast the model toy train is traveling.

While the invention has been described in connection with what is presently considered to be the most practical and preferred embodiments, it is to be understood that the invention is not limited to the disclosed embodiments but, on the contrary, is intended to cover various modifications and equivalent arrangements included within the spirit and scope of the appended claim, which scope is to be accorded the broadest interpretation so as to encompass all such modifications and equivalent structure as permitted under the law.

What is claimed is:

1. A puffing smoke unit for a model toy train comprising:

a smoke generator including an inlet hole and an exhaust hole;

a fan to direct an airstream through the smoke generator; and a blocker movable between an open position and a closed position to intermittently restrict the airstream with respect to the smoke generator, the fan operable to direct the airstream with respect to the smoke generator when the blocker is in the open and closed positions.

2. A puffing smoke unit as in claim 1 wherein the fan is positionable internally respect to the smoke generator.

3. A puffing smoke unit as in claim 1 wherein the blocker is positionable upstream of the fan with respect to the airstream.

4. A puffing smoke unit as in claim 1 wherein the blocker is positionable downstream of the fan with respect to the airstream.

5. A puffing smoke unit as in claim 4 further comprising:

the blocker is biased to the closed position and movable to the open position by a predetermined pressure difference between the airstream internal with respect to the smoke generator and ambient air.

6. A puffing smoke unit as in claim 1 wherein the fan is positioned within a fan housing, the fan housing positionable adjacent the smoke generator.

7. A puffing smoke unit as in claim 6 wherein the fan housing is immediately adjacent to the smoke generator.

8. A puffing smoke unit as in claim 1 further comprising:

the blocker engageable with an axle of the model toy train such that the blocker is movable between the open and closed positions in response to movement of the axle.

9. A puffing smoke unit as in claim 1 further comprising:

a solenoid operably engaged with the blocker to move the blocker between the open and closed positions.

10. A puffing smoke unit as in claim 1 further comprising:

a conduit operably engaged with the exhaust hole and a smoke stack of the model toy train, the airstream movable in the conduit from the smoke generator to the smoke stack.

11. A puffing smoke unit as in claim 10 further comprising:

the blocker positionable in the conduit.

12. A method of creating a puffing action in a model toy train comprising the steps of:

generating smoke with a smoke generator including an inlet hole and an exhaust hole;

directing an airstream through the smoke generator with a fan; and intermittently restricting the airstream with respect to the smoke generator with a blocker movable between an open position and a closed position, the fan operable to direct the airstream with respect to the smoke generator when the blocker is in the open and closed positions.

13. A method of creating a puffing action as in claim 12 wherein the restricting step further comprises the step of:

moving the blocker between the open and closed positions at a rate corresponding to a speed of the model toy train so that as the speed of the model toy train increases the rate of movement of the blocker between the open and closed positions increases.

14. A puffing smoke unit as in claim 12 wherein the restricting step further comprises step of:

moving the blocker to the closed position to at least partially obstruct the airstream while the fan directs the airstream to increase an air pressure internal with respect to the smoke generator.

15. A puffing smoke unit as in claim 12 wherein the restricting step further comprises the step of:

moving the blocker to the closed position to at least partially obstruct the airstream while the fan directs the airstream to decrease an air pressure internal with respect to the smoke generator.

16. A puffing smoke unit as in claim 12 further comprising the steps of:

positioning the smoke generator spaced apart from a smoke stack of the model toy train;

placing the smoke generator in fluid communication with the smoke stack with a conduit; and positioning the blocker internal with respect to the conduit.

17. A puffing smoke unit for a model toy train comprising:

a smoke generator including an a housing, an inlet aperture and an exhaust aperture, smoke generated internal with respect to the housing;

a fan positionable with respect to the housing to direct an airstream through the housing; and a blocker movable between an open position and a closed position to intermittently restrict the airstream with respect to the housing of the smoke generator, the fan operable to direct the airstream with respect to the housing when the blocker is in the open and closed positions.

18. A puffing smoke unit as in claim 17 further comprising:

the blocker including a plate, a lever arm an cam follower, the plate at least partially covering one of the inlet aperture and outlet aperture in the closed position and spaced apart from the one in the open position, the lever arm engaged with the mounting plate and the cam follower, the cam follower in contact with an axle of the model toy train to move the lever arm and the plate in response to rotation of the axle.

* * * * *